United States Patent [19]

Goldman

[11] Patent Number: 5,021,315

[45] Date of Patent: Jun. 4, 1991

[54] METHOD FOR MAKING MAGNETIC PARTICLES HAVING IMPROVED CONDUCTIVITY AND THEIR USE IN ELECTROSTATOGRAPHIC PRINTING APPLICATIONS

[75] Inventor: Dov B. Goldman, Secaucas, N.J.

[73] Assignee: Olin Hunt Sub I Corp., Cheshire, Conn.

[21] Appl. No.: 364,046

[22] Filed: Jun. 7, 1989

[51] Int. Cl.[5] ..... G03G 9/083

[52] U.S. Cl. ..... 430/106.6; 430/137; 427/217

[58] Field of Search ..... 430/106.6, 108, 137; 428/403; 427/216, 217

[56] References Cited

U.S. PATENT DOCUMENTS

| | | | |
|---|---|---|---|
| 4,443,527 | 4/1984 | Heikens et al. | 430/39 |
| 4,486,523 | 12/1984 | Hosfeld et al. | 430/106.6 |
| 4,530,893 | 7/1985 | Maekawa et al. | 430/106 |
| 4,536,462 | 8/1985 | Mehl | 430/106 |
| 4,543,382 | 9/1985 | Tsuchida et al. | 524/267 |
| 4,623,602 | 11/1986 | Bakker et al. | 430/106 |
| 4,640,880 | 2/1987 | Kawanishi et al. | 430/106.6 |
| 4,740,443 | 4/1988 | Nakahara et al. | 430/106.6 |
| 4,898,801 | 2/1990 | Tachibana et al. | 430/106.6 |
| 4,925,762 | 5/1950 | Ostertag et al. | 430/106.6 |

*Primary Examiner*—John Goodrow

*Attorney, Agent, or Firm*—Donald M. Papuga

[57] ABSTRACT

The present invention provides for a method for the preparation of red colored magnetic particles for multicomponent toner compositions which are highly conductive and therefore suitable for use as developers in high speed electrophotographic copy machines embodying magnetic brush development. Suitable magnetic core metal particles are provided which are subsequently coated with finely divided particles of copper oxide (CuO). The copper oxide coating is then reduced in-situ on the surface of the core particle to provide an electrically conductive core particle uniformly coated with adherent metallic copper, which particle is of a red color.

The present invention also provides a method for controlling and adjusting the electrical conductivity and color of toner materials as a function of the amount of metallic copper deposited on the surface of the magnetic core materials.

10 Claims, No Drawings

METHOD FOR MAKING MAGNETIC PARTICLES HAVING IMPROVED CONDUCTIVITY AND THEIR USE IN ELECTROSTATOGRAPHIC PRINTING APPLICATIONS

BACKGROUND OF THE INVENTION

1. Field of the Invention

This invention relates to highly conductive magnetic particles applications and to a method for preparing such conductive colored magnetic particles, as well as their use in electrostatographic toner compositions.

2. Description of Related Art

Electrostatic charge patterns may be reproduced by means of one of the generally known electrostatographic printing processes, e.g. xerography or by means of a stylus as used for example in a computer printout. The resulting charge pattern may be made visible by means of a toner powder, which by one of the many conventional methods known, is brought into contact with the charge pattern to be developed. These toner powders generally consist of finely divided particles containing a binder and coloring agents.

For some electrostatographic printing applications, it is desirable that the toner powders also contain a magnetic material.

Typical magnetic materials which have appropriate magnetic and electrical properties for use in the preparation of such toner powders include finely divided metal powders of iron, nickel, cobalt, chromium dioxide, gamma ferrioxide and ferrites having a particle size in the range of from about 1 to 50 microns. Many of these materials however exhibit relatively poor electrical conductivity and have an electrical resistivity in the order of $10^5$ ohms or greater. Poor electrical conductivity means that mono-component toners containing such particles are not suitable for use in some high speed copy machines which embody a magnetic brush development apparatus.

This problem of poor conductivity of these magnetic materials may be overcome by the addition of highly conductive carbon black to the toner formulation. Such products containing the mixture of magnetic particles and highly conductive carbon black are, however, black in color and consequently the resultant toner compositions are limited for use in the production of black images in the electrostatographic process. Such a toner formulation can not be satisfactorily employed to make colored toner wherein the capability of color highlighting of dark or black images is desired. Neutral colored or matched colored conductive materials which might be added to colored toners to enhance conductivity are not readily available.

SUMMARY OF THE INVENTION

The present invention provides for a method for the preparation of red colored magnetic particles for electrostatographic toner compositions which are highly conductive and therefore suitable for use as developers in electrophotographic processes. According to the present invention, suitable magnetic core metal particles are provided which are subsequently coated with finely divided particles of copper oxide (CuO). The copper oxide coating is then reduced in-situ on the surface of the core particle to provide an electrically conductive core particle uniformly coated with adherent metallic copper, which particle is of a red color.

The present invention also provides a method for controlling and adjusting the electrical conductivity of toner materials as a function of the amount of metallic copper deposited on the surface of the magnetic core materials.

DETAILED DESCRIPTION OF THE INVENTION

The present invention takes advantage of the fact that copper is a highly conductive metal which has a reddish color, and provides a simple and straightforward technique for imparting both of these properties into magnetic core particles which may be used as a component in monocomponent toner materials.

Because the resulting highly conductive magnetic particles of this invention are reddish in color, the preferred metallic core particles for use in this invention are based on iron oxide materials which are yellow, brown or reddish in color. These would include gamma $Fe_2O_3$, magnetite and ferrite materials. Examples of suitable magnetites include commercially available acicular magnetites and cubical magnetites such as available from Pfizer Corporation under the designation MO-4131 and MO-4232, and cubical magnetites such as MO-7029. Also suitable are polyhedral magnetites available from Hercules Corporation as Ex 1601 and XMT-100.

While dark colored or black magnetic core particles are not preferred for the purposes of this invention because of their dark color may bleed through the red surface color. Such dark colored particles can be modified to change their surface color and therefore render them suitable in the manufacture of the red colored conductive toner of this invention. For example, magnetic particles based on the oxides of nickel, cobalt and chromium can be treated by processes such as disclosed in U.S. Pat. No. 4,443,527, the disclosure of which is incorporated herein by reference, to produce magnetic powders having a yellow, brown or reddish color. This patent discloses the preparation of colored toner particles containing magnetic material wherein a magnetic particle or a toner particle containing a mixture of finely divided magnetic particles dispersed in a fusible binder is first coated with a masking layer composed of a reflecting pigment such as titanium dioxide dispersed in a binder resin. This is followed by contacting the masked particle with a suitable dye or pigment composition wherein the dye or pigment coats or becomes embedded in said masking layer. A similar approach is disclosed in U.S. Pat. No. 4,623,602 except that the masking layer and colored layer contain a yellow fluorescent dye, and binders are used in which the dye fluoresces.

Generally speaking, the magnetic core particles suitable for the purposes of this invention have an average particle size within the range of from about 1 to about 50 microns, with the preferred particle size ranging from about 1 to about 15 microns.

In its broader aspects, the present invention provides for the coating of magnetic core particles with the copper oxide by any suitable technique such as slurry coating or ball mixing. The preferred process however is to deposit particles by precipitation of a water soluble and decomposible copper salt onto the surface of the core particle, followed by heating of the precipitated salt to decompose it into copper oxide. This insures that the deposited copper salt and its decomposition product are present uniformly adhered to the core particle surface and in very finely divided form. For example, finely divided particles of copper oxide may be deposited on magnetic core particles by forming a slurry of the core particles in an aqueous or alcohol solution of copper nitrate, acetate or sulfate (e.g. a 30% by weight aqueous solution), followed by air drying the slurry and heating the dried slurry in air at a temperature in excess of the decomposition temperature of the dried copper salt residue which causes the copper oxide decomposition product to precipitate onto the surface of the core particle. Suitable salts for use in this process include the nitrates, sulfates, acetates and other readily decomposible metal salts.

It is most preferred to decompose the copper salt at as low a temperature as possible (e.g., at temperatures of from about 200° C. to about 400° C.). Copper acetate and copper nitrate may be thermally decomposed at temperatures in the order of 300° C. and are therefore preferred salts for the purposes of this invention. The time required for complete decomposition of the copper salt depends upon temperature, but generally ranges from about 1 hour to about 5 hours.

The copper oxide which is precipitated onto the surface of the core particle is generally submicronic in size such that it forms a substantially uniform opaque film over the entire surface of the core particle. In general, the particle size of the core particles ranges from about 10 to about 100 or more times as great as the particle size of the copper oxide coating.

The next step in the process is the in-situ reduction the copper oxide coating present on the magnetic core particle to copper metal. This may be readily accomplished by heating oxide coated particles to a temperature within the range of from about 150° C. to about 200° C. in a flow of hydrogen and for a period of time sufficient to cause the reduction of the oxide to the base metal. The time required for reduction depends to a large degree on temperature and hydrogen concentration, but generally ranges form about 20 to about 90 minutes.

As indicated above, the relative improvement in conductivity and the color of the resulting copper-coated core particles may be controlled as a function of the amount of copper deposited on the core particle in the form of the oxide. Generally speaking, quantities of copper oxide in the range of from about 5 to about 60% by weight based on the total weight of the coated core particles are sufficient to significantly improve the post reduction conductivity of the particles and provide desired reddish colors. The preferred level of copper oxide ranges from about 30 to about 50% by weight of the total weight of the core particle. Core magnetic particles having resistivity values of from about 1 ohm to about 100 ohms may be readily prepared in accordance with the present invention.

The colored magnetic particles of the present invention are adapted for use in mono-component compositions. Generally such toner compositions are based on a fusible binder polymer having the colored magnetic particles of this invention uniformly dispersed therein, generally at a level of from about 1 to about 70% by weight.

The fusible binder polymers that can be used in the compositions of the invention include the various polymers that conventionally have been employed in dry electrostatic toners. These generally have a glass transition temperature within the range from 40° to 120° C. Preferably, the toner particles may have relatively high caking temperature, for example, higher than about 55° C., so that they may be stored without agglomerating. The softening temperature may also be within the range from 40° C. to 200° C., and preferably from 40° C. to 65° C., so that the toner particles can readily be fused to paper receiving sheets. If other types of receiving elements are used, for example, metal printing plates, polymers having a higher softening temperature and glass transition temperature may be used.

Advantageously, the fusible binder comprises 25 percent by weight or more of the toner particles used in the invention. It may be advantageous to use toner particles comprising at least 50 percent by weight, and preferably 50–95 percent by weight, of the binder polymers.

The fusible binder polymers which may be employed in the toner compositions of the invention may include homopolymers and copolymers of styrene, polycarbonates, resin-modified maleic alkyd resins, polyamides, phenol-formaldehyde resins and derivatives thereof, polyesters, modified alkyd resins, aromatic resins containing alternating methylene and aromatic units such as described in Merrill et al, U.S. Pat. No. 3,809,554, and fusible cross-linked polymers as described in Jadwin et al U.S. Pat. No. 3,938,992.

Especially useful may be styrene-acrylic copolymers of from 40 to 100 percent by weight of styrene or styrene homologs; from 0 to 45 percent by weight of one or more lower alkyl acrylates or methacrylates having from 1 to 4 carbon atoms in the alkyl group; and from 0 to 50 percent by weight of one or more other vinyl monomers, for example, a higher alkyl acrylate or methacrylate (including branched alkyl) and cycloalkyl acrylates and methacrylates) having from 6 to 20 or more carbon atoms in the alkyl group. One preferred styrene-containing copolymer of this kind is prepared from a monomeric blend of 40 to 60 percent by weight styrene or styrene homolog, from 20 to 50 percent by weight of a lower alkyl acrylate or methacrylate and from 5 to 30 percent by weight of a higher alkyl acrylate or methacrylate such as ethylhexyl acrylate. Other preferred fusible styrene copolymers are those which are covalently cross-linked with a small amount of a divinyl compound such as divinylbenzene.

The toner compositions of the present invention also desirably include suitable charge control agents which can provide appropriate positive or negative tribo values as specified for any given electrostatographic apparatus. Illustrative of such agents without adversely effecting the final toner color and quarternary ammonium salts (Bontron P-51) for positive toners and metal salts or complexes such as Bontron 5-34, E-82, E-84 and E-88 for negative toners. Organic salts such as ceryl pyridinium chloride and stearyl dimethyl phenethyl ammonium para-totuene sulfonate are also useful charge control agents. Preferably, the charge directors color should be the same or similar to the desired final color of the toner.

The charge control agents may be added to the toner in an amount effective to improve the charge properties of the toner composition. These charge control agents improve the charge uniformity of a toner composition, that is, they insure that substantially all of the individual toner particles exhibit a triboelectric charge of the same sign (negative or positive) with respect to a given carrier.

In the toner compositions of the present invention it would also be desirable to employ an amount of at least one charge control agent within the range of 0.01 to 5 weight percent and preferably 0.2 to 3 weight percent based on the total weight of the particulate toner composition. If much lower amounts are used, the charge control agent provides little or no effect. If much higher amounts are used, the net charge of the toner may become unstable or too conductive and the net charge may not be retained. The optimum amount will depend on the components selected for the particular toner composition.

The toner composition may also advantageously contain flow control agents or lubricants. These may include anhydrous silicon dioxide and also silicates such as aluminum silicate, sodium silicate, potassium silicate, magnesium silicate, zinc silicate, alumina powder, polyvinylidene fluoride powder, and metal stearates such as zinc stearate. The amount of such flow control additives added to the toner composition generally ranges from about 0.5 to about 5.0% by weight, based on the total toner weight.

A convenient method for preparing the toner is melt blending. This involves melting the binder polymer and mixing it with other additives on heated compounding rolls. After thorough blending, the mixture is cooled and solidified. The solid mass is broken into small particles and finely ground to form a free-flowing power of toner particles, which may then be further screened to remove large particles.

The toners of this invention maybe used in monocomponent toners or may be mixed with a carrier material for two-component developers. Magnetic carrier particles can be used, in addition to the colored magnetic particles of this invention.

The above described toner and developer composition can be used in MICR applications such as described in U.S. Pat. No. 4,517,268.

Developable charge patterns can be prepared by a number of well-known means and be carried, for example, on a light sensitive photoconductive element or a non-light sensitive dielectric-surfaced receiving element. Suitable dry development processes include cascading a cascade developer composition across the electrostatic charge pattern as described in detail in U.S. Pat. Nos. 2,618,551; 2,618,552; and 2,638,416. Another process involves applying toner particles from a magnetic brush developer composition as described in U.S. Pat. No. 3,003,462. Still another useful development process is powder-cloud development wherein a gaseous medium such as air is utilized as a carrier vehicle to transport the toner particles to the electrostatic charge pattern to be developed. This development process is more fully described in U.S. Pat. Nos. 2,691,345 and 2,725,304. Yet another development process is for brush development wherein the bristles of a brush are used to transport the toner particles to the electrostatic charge pattern to be developed. This development process is more fully described in Walkup, U.S. Pat. No. 3,251,706.

After imagewise deposition of the toner particles in accord with the process of the invention, the image can be fused as described earlier herein to adhere it to the substrate bearing the toner image. Radiant heaters or heated fuser rolls may be employed to provide fusion heat. If desired, the unfused image can be transferred to another support such as a blank sheet of copy paper and then fused to form a permanent image thereon.

The following Examples are illustrative of the preparation of the highly conductive colored magnetic particles of the invention.

EXAMPLE 1

Thirty grams of red colored gamma ferric oxide ($Fe_2O_3$) powder having an average particle size of 1 micron was slurried in 88 grams of copper nitrate $Cu(NO_3)_2(2.5\ H_2O)$ which was previously dissolved in ethyl alcohol. This resultant slurry was then air dried and heated in air at 300° C. for three hours to completely decompose the copper nitrate and form a submicron copper oxide (CuO) particles, which precipitated onto the surface of the ferric oxide particles. The oxide-coated particles were then exposed to a flow of hydrogen gas (1.0 liters per minute) at 170° C. for a period of thirty three minutes to reduce the copper oxide to basic copper metal.

The resultant aggregate ferric oxide/copper metal particles were of a red color and exhibited a resistivity of 2 ohms. This is to be compared with the initial resistivity of the gamma ferric oxide particles which was measured at greater than $10^7$ ohms.

EXAMPLE 2

Copper nitrate $[Cu(NO_3)_2.2.5H_2O]$ was heated in air at 300° C. for three hours, thereby it decomposed into submicron CuO particles. $N_2O_5$ and $H_2O$ vapor evolved during this decomposition, leaving the solid Cu particles. Thirty grams of these submicron CuO particles were mixed with a small amount of ethyl alcohol to wet the particles. Then 30 grams of red colored gamma-ferric oxide was mixed with the CuO/alcohol mixture. The resultant oxide mixture was then exposed to a flow of hydrogen gas (0.5 liters per minute) at 170° C. for 50 minutes. During this period, the CuO was reduced to copper metal and the resulting copper metal and gamma $Fe_2O_3$ particles formed aggregates.

The resulting aggregate particles were of a red color and exhibited a resistivity of 6 ohms.

What is claimed is:

1. A process for making conductive colored magnetic particles comprising:

a) providing magnetic core particles comprising a finely divided metal oxide, said particles having an average particle size within the range of from about 1 to about 50 microns, b) depositing finely divided submicron size particles of copper oxide on the surface of said core particles, and c) reducing said copper oxide to metallic copper.

2. The process of claim 1 wherein said deposition of step (b) is carried out by mixing said magnetic core particles with a solution of a water or alcohol soluble salt of copper and precipitating particles of copper in the form of copper oxide on the surface of said core particles.

3. The process of claim 2 wherein said precipitation is carried out by evaporating said solution of water soluble salt and heating the residue at a temperature sufficient to decompose said water soluble salt to copper oxide.

4. The process of claim 1 wherein said magnetic core particles are composed of gamma $Fe_2O_3$.

5. The process of claim 3 wherein said heating is conducted at a temperature within the range of from about 200° to about 400° C.

6. The process of claim 3 wherein said copper oxide is reduced by heating the core particles coated with copper oxide in a stream of hydrogen gas and at a temperature below about 200° C. for a period of time sufficient to reduce said copper oxide to metallic copper.

7. The process of claim 1 wherein the amount of copper oxide present on the surface of said core particles constitutes from about 5 to about 60% by weight based on the total weight of the coated core particles.

8. Finely divided conductive colored magnetic particles produced by the process of claim 1.

9. The particles of claim 8 having a resistivity within the range of from about 1 to about 100 ohms.

10. A colored particulate toner composition comprising a uniform mixture of a fusible binder resin having the colored magnetic particles of claim 8 dispersed therein.

* * * * *